US009359829B2

(12) United States Patent
Tan et al.

(10) Patent No.: US 9,359,829 B2
(45) Date of Patent: Jun. 7, 2016

(54) RISER ASSEMBLY AND METHOD OF PROVIDING RISER ASSEMBLY

(71) Applicants: Zhimin Tan, Houston, TX (US); Yanqiu Zhang, Houston, TX (US); Yucheng Hou, Houston, TX (US)

(72) Inventors: Zhimin Tan, Houston, TX (US); Yanqiu Zhang, Houston, TX (US); Yucheng Hou, Houston, TX (US)

(73) Assignee: Wellstream International Limited (GB)

( * ) Notice: Subject to any disclaimer, the term of this patent is extended or adjusted under 35 U.S.C. 154(b) by 0 days.

(21) Appl. No.: 14/353,878

(22) PCT Filed: Oct. 18, 2012

(86) PCT No.: PCT/GB2012/052584

§ 371 (c)(1),
(2) Date: Apr. 24, 2014

(87) PCT Pub. No.: WO2013/061033

PCT Pub. Date: May 2, 2013

(65) Prior Publication Data

US 2014/0262316 A1 Sep. 18, 2014

Related U.S. Application Data

(60) Provisional application No. 61/552,316, filed on Oct. 27, 2011.

(51) Int. Cl.
*E21B 17/01* (2006.01)

(52) U.S. Cl.
CPC ..... *E21B 17/012* (2013.01); *E21B 17/015* (2013.01); *E21B 17/017* (2013.01)

(58) Field of Classification Search
CPC ..... E21B 17/012; E21B 17/015; E21B 17/20
USPC ..... 405/224.2, 224.3, 195.1; 166/343, 344, 166/345, 346, 350, 355, 359; 441/4, 23, 28
See application file for complete search history.

(56) References Cited

U.S. PATENT DOCUMENTS 3,295,489 A * 1/1967 Bossa ..... 114/294
4,065,822 A * 1/1978 Wilbourn ..... 441/4

(Continued)

FOREIGN PATENT DOCUMENTS

GB 2295408 A 5/1996
WO 2007043862 A1 4/2007

(Continued)

OTHER PUBLICATIONS

PCT International Preliminary Report of Patentability and Written Opinion for PCT/GB2012/052584, mailed Apr. 29, 2014 (12 pages).

(Continued)

*Primary Examiner* — James G Sayre
(74) *Attorney, Agent, or Firm* — Reza Mollaaghababa; Thomas Engellenner; Pepper Hamilton LLP

(57) ABSTRACT

A riser assembly and method of producing a riser assembly for transporting fluids from a sub-sea location is disclosed. The assembly includes a riser comprising at least one segment of flexible pipe, the riser having a first end for connection to a floating facility and a further end; at least one buoyancy element for enabling a portion of the riser to form a hog bend configuration and an adjacent portion of the riser to form a sag bend configuration; and a weight element provided between the first end of the riser and the at least one buoyancy element, such that in an initial deployment position, the weight element is provided at least partially in the sag bend portion of the riser.

15 Claims, 5 Drawing Sheets

(56) References Cited

U.S. PATENT DOCUMENTS

| | | | | |
|---|---|---|---|---|
| 4,075,862 | A * | 2/1978 | Ames | 405/169 |
| 4,263,004 | A * | 4/1981 | Joubert et al. | 405/172 |
| 4,941,776 | A * | 7/1990 | Bosgiraud et al. | 405/224 |
| 5,505,560 | A * | 4/1996 | Brown et al. | 405/195.1 |
| 6,030,145 | A * | 2/2000 | Stewart et al. | 405/172 |
| 8,562,256 | B2 * | 10/2013 | Li et al. | 405/224.2 |
| 2006/0159521 | A1 * | 7/2006 | Streiff et al. | 405/158 |
| 2009/0133612 | A1 * | 5/2009 | Wajnikonis | 114/199 |
| 2011/0155383 | A1 * | 6/2011 | Christiansen et al. | 166/345 |
| 2011/0247826 | A1 * | 10/2011 | McCann | 166/337 |

FOREIGN PATENT DOCUMENTS

| | | | | |
|---|---|---|---|---|
| WO | 2009063163 | A1 | 5/2009 | |
| WO | 2011028432 | A2 | 3/2011 | |
| WO | WO 2011028432 | A3 * | 5/2011 | E21B 17/01 |

OTHER PUBLICATIONS

Yanquin Zhang et al., "Design Analysis of a Weight Added Wave Configuration of a Flexible Riser in Shallow Water." Proceedings of the ASME 29th International Conference on Ocean, Offshore and Arctic Engineering—2010: Presented at 29th International Conference on Ocean, Offshore and Arctic Engineering, pp. 403-410, Jun. 6-11, 2010.

PCT International Preliminary Report of Patentability and Written Opinion for PCT/GB2012/052584, mailed Aug. 28, 2013 (15 pages).

Japanese Office Action for corresponding Japanese Application 201280053185.1 dated Jul. 24, 2015.

Chinese Office Action for corresponding Chinese Application 201280053185.1 dated Jul. 24, 2015.

Chinese Office Action (English Translation) for corresponding Chinese Applicaiton 201280053185.1 dated Apr. 1, 2016.

* cited by examiner

RISER ASSEMBLY AND METHOD OF PROVIDING RISER ASSEMBLY

BACKGROUND

The present invention relates to a riser assembly and method of providing a riser assembly. In particular, but not exclusively, the present invention relates to a riser assembly suitable for use in the oil and gas industry, to help prevent unwanted movement of buoyancy modules after installation.

Traditionally flexible pipe is utilised to transport production fluids, such as oil and/or gas and/or water, from one location to another. Flexible pipe is particularly useful in connecting a sub-sea location (which may be deep underwater, say 1000 meters or more) to a sea level location. The pipe may have an internal diameter of typically up to around 0.6 meters. Flexible pipe is generally formed as an assembly of a flexible pipe body and one or more end fittings. The pipe body is typically formed as a combination of layered materials that form a pressure-containing conduit. The pipe structure allows large deflections without causing bending stresses that impair the pipe's functionality over its lifetime. The pipe body is generally built up as a combined structure including metallic and polymer layers.

In known flexible pipe design the pipe includes one or more tensile armour layers. The primary load on such a layer is tension. In high pressure applications, the tensile armour layer experiences high tension loads from the internal pressure end cap load as well as weight. This can cause failure in the flexible pipe since such conditions are experienced over prolonged periods of time.

One technique which has been attempted in the past to in some way alleviate the above-mentioned problem is the addition of buoyancy aids at predetermined locations along the length of a riser. The buoyancy aids provide an upwards lift to counteract the weight of the riser, effectively taking a portion of the weight of the riser, at various points along its length. Employment of buoyancy aids involves a relatively lower installation cost compared to some other configurations, such as a mid-water arch structure, and also allows a relatively faster installation time. Examples of known riser configurations using buoyancy aids to support the riser's middle section are shown in FIGS. 1*a* and 1*b*, which show the 'steep wave' configuration and the 'lazy wave' configuration, respectively. In these configurations, there is provided a riser assembly 200 suitable for transporting production fluid such as oil and/or gas and/or water from a subsea location to a floating facility 202 such as a platform or buoy or ship. The riser is provided as a flexible riser, i.e. including a flexible pipe, and includes discrete buoyancy modules 204 affixed thereto. The positioning of the buoyancy modules and flexible pipe can be arranged to give a steep wave configuration $\mathbf{206}_1$ or a lazy wave configuration $\mathbf{206}_2$.

Wave riser configurations as shown in FIGS. 1*a* and 1*b* are often used in shallow water applications so as to allow for excursions of the vessel from the point where the riser contacts the sea bed.

However, in some applications, the buoyancy modules may react to changes in riser assembly weight, for example caused by marine growth (shellfish and other sea life and/or sea debris attaching to the riser). Alternatively or additionally, the riser assembly and/or the buoyancy modules may experience a gradual (or sudden) change in content density due to movement or general day to day wear for example. This may cause the amount of buoyancy support or net buoyancy (and therefore the relative height above the sea bed) of the riser to change. Any change in the amount of buoyancy support may have an adverse effect on the tension relief provided to the flexible pipe, which could ultimately decrease the lifetime of a riser.

Furthermore, such changes in weight could lead to an undesirable situation where the riser assembly diverts completely from its designated configuration by either popping up to the water's surface or sinking to the sea bed. This is particularly applicable to shallow water applications (less than 1000 feet (304.8 meters)), since any change in buoyancy has a more pronounced effect on the height change at shallow depths. Interference with any neighbouring riser assemblies or vessel structures could become a problem.

WO2009/063163, incorporated herein by reference, discloses a flexible pipe including weight chains secured to a number of buoyancy modules on the pipe. The chains hang from the buoyancy modules, extending downwards to the sea bed and having an end portion lying on the sea bed. The weight associated with each length of chain counteracts the buoyancy provided by the respective buoyancy module to which it is secured. That is, when the density of a riser section decreases and the pipe begins to rise towards the water surface, the amount of chain suspended between the buoyancy module and the seabed is increased (i.e. heavier), thus offsetting the pipe's tendency to rise upwards. When the density of a riser section increases and the pipe begins to descend towards the sea bed, the amount of chain suspended between the buoyancy module and the seabed is decreased (i.e. lighter), again offsetting the pipe's tendency to descend down to the sea bed.

It would be useful to provide an alternative to the assembly described in WO2009/063163.

In addition, particularly in shallow water applications, it would be useful to be able to ensure a certain minimum clearance distance between a so-called sag bend and the seabed, and also between a so-called hog bend and the sea surface and/or a vessel or structure at the surface. A sag bend 208 is a U-shaped bend in a riser and a hog bend 210 is an inverted U-shaped bend in a riser (as indicated in FIG. 1*a*). This would help to ensure that the riser does not pop up to the water's surface or sink to the sea bed, or collide with a vessel or other structure.

SUMMARY

It is an aim of embodiments of the present invention to provide a riser assembly and method for manufacturing a riser assembly suitable for operating in shallow water.

It is an aim of embodiments of the present invention to provide a riser assembly to which buoyancy modules can be secured or are included integrally so as to provide the advantages of a buoyed riser, without the disadvantages associated with variations in riser weight.

It is an aim of embodiments of the present invention to provide a riser assembly that has relatively low installation costs and short installation time, compared to known riser assembles.

According to a first aspect of the present invention there is provided a riser assembly for transporting fluids from a subsea location, comprising:

- a riser comprising at least one segment of flexible pipe, the riser having a first end for connection to a floating facility and a further end;
- at least one buoyancy element for enabling a portion of the riser to form a hog bend configuration and an adjacent portion of the riser to form a sag bend configuration; and
- a weight element provided between the first end of the riser and the at least one buoyancy element, such that in an initial deployment position, the weight element is provided at least partially in the sag bend portion of the riser.

According to a second aspect of the present invention there is provided a riser assembly for transporting fluids from a sub-sea location, comprising:

a riser comprising at least one segment of flexible pipe, the riser having a first end for connection to a floating facility and a further end;

means for maintaining a hog bend portion of the riser a predetermined distance from the water surface in use; and a tethering element for tethering the riser in the region of the further end to a fixed structure.

According to a third aspect of the present invention there is provided a method of providing a riser assembly for transporting fluids from a sub-sea location, comprising:

providing a riser comprising at least one segment of flexible pipe, the riser having a first end for connection to a floating facility and a further end;

providing at least one buoyancy element for enabling a portion of the riser to form a hog bend configuration and an adjacent portion of the riser to form a sag bend configuration; and providing a weight element between the first end of the riser and the at least one buoyancy element, such that in an initial deployment position, the weight element is provided at least partially in the sag bend portion of the riser.

According to a fourth aspect of the present invention there is provided a method of providing a riser assembly for transporting fluids from a sub-sea location, comprising:

providing a riser comprising at least one segment of flexible pipe, the riser having a first end for connection to a floating facility and a further end;

providing means for maintaining a hog bend portion of the riser a predetermined distance from the water surface in use; and providing a tethering element for tethering the riser in the region of the further end to a fixed structure.

Certain embodiments of the invention provide the advantage that a riser assembly is provided that is less sensitive to changing riser weight or changing riser buoyancy than some known configurations. For example, a weight element provided at least partially in the sag bend portion of the riser may be used to offset a relatively larger initial buoyancy of a riser section at an adjacent hog bend portion. In time, as the weight of the riser changes, for example the weight increasing due to the occurrence of marine growth and such like, much of the riser will sink down towards the sea bed. The change in overall configuration of the riser will mean that the weight element will effectively move to the more vertical portion (the suspended section) of the riser, rather than being located in the sag bend. Of course the weight element will not move relative to the riser. However, the amount of flexible pipe being suspended will increase, and pipe previously part of the sag bend will become part of the suspended section. As such, the weight of the weight element will be taken by the floating facility and not by the buoyancy modules.

Certain embodiments of the invention provide the advantage that a riser assembly is provided that can automatically offset variations in riser weight or riser buoyancy.

Certain embodiments of the invention provide the advantage that a riser assembly is provided that can be installed relatively quickly and at relatively low cost compared to known configurations.

Certain embodiments of the invention provide the advantage that a riser assembly is provided that is designed to ensure a certain minimum clearance distance between a sag bend and the seabed, and also between a hog bend and the sea surface or surface vessel or structure. This helps to ensure that the riser does not pop up to the water's surface, or collide with the floating facility from which it is suspended, or sink down to hit the sea bed, any of which could cause damage to the riser assembly.

BRIEF DESCRIPTION OF THE FIGURES

Embodiments of the invention are further described hereinafter with reference to the accompanying drawings, in which.

DETAILED DESCRIPTION

Figure 1A:
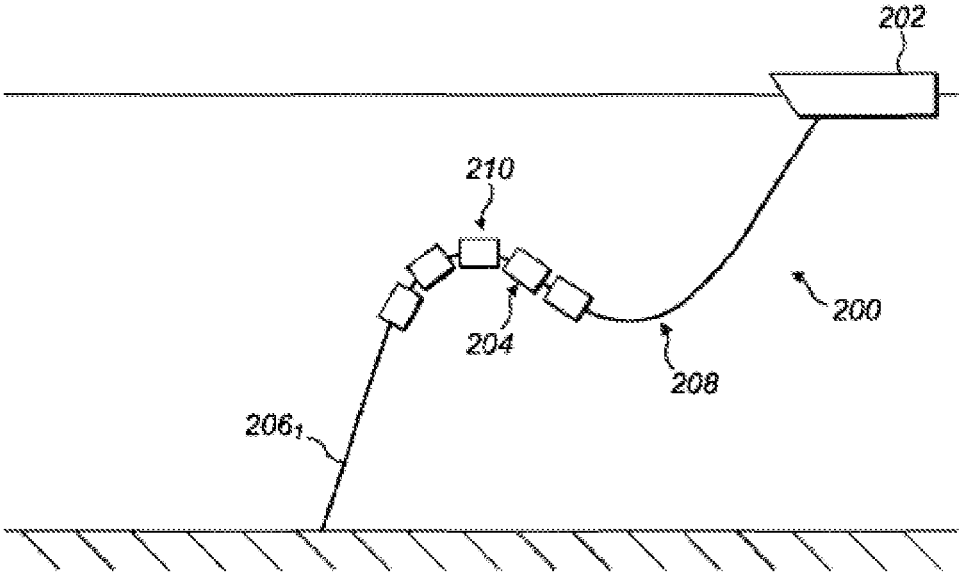
FIG. 1a (PRIOR ART)
FIG. 1*a* illustrates a known riser assembly.
Figure 1B:
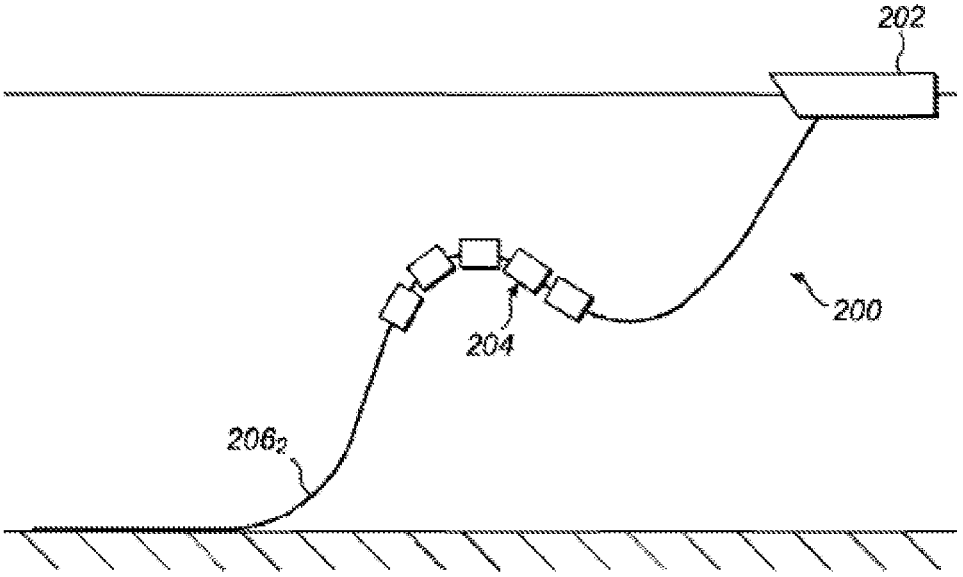
FIG. 1b (PRIOR ART)
FIG. 1*b* illustrates another known riser assembly.

In the drawings like reference numerals refer to like parts.

Figure 2:
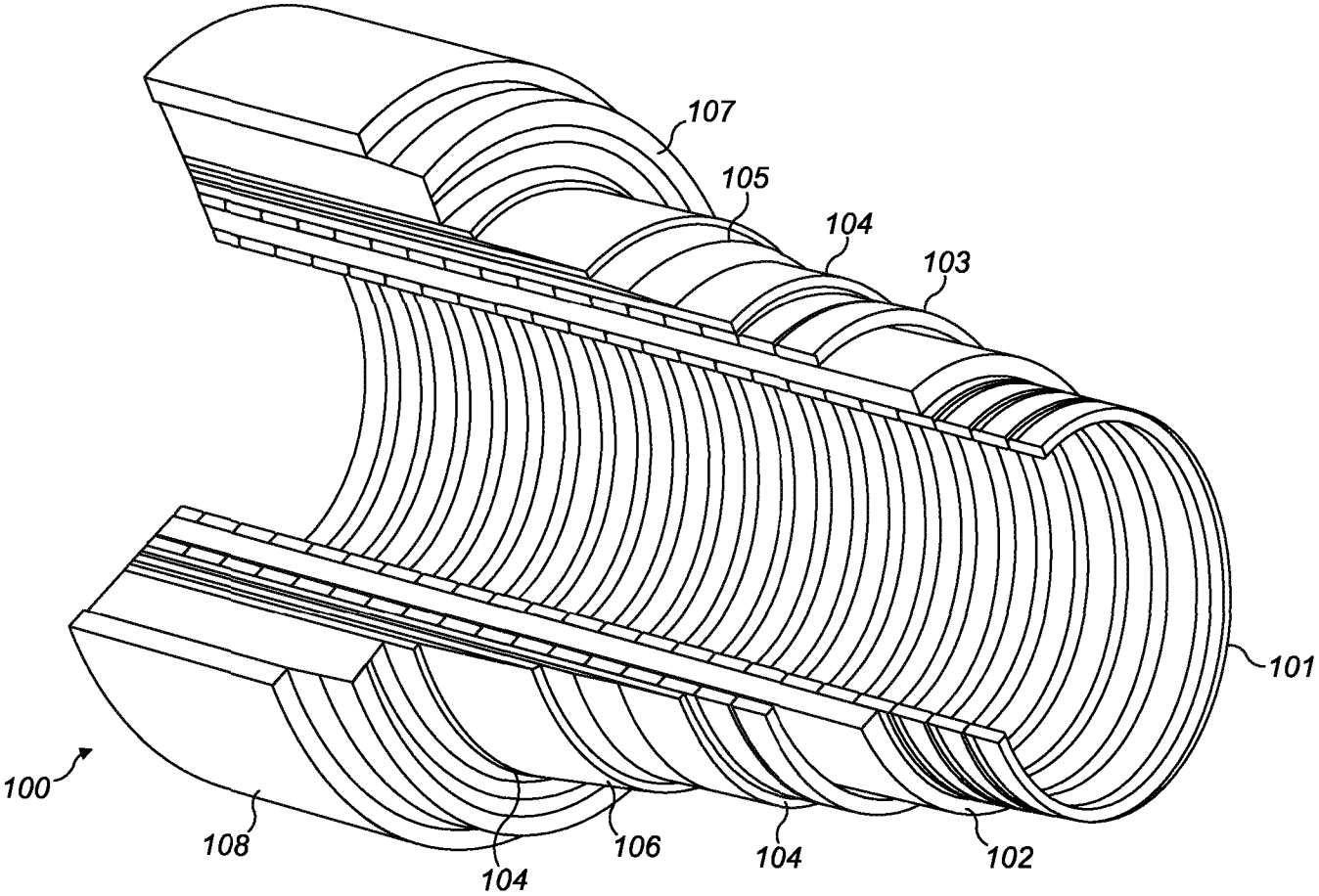
FIG. 2 illustrates a flexible pipe body.

Throughout this description, reference will be made to a flexible pipe. It will be understood that a flexible pipe is an assembly of a portion of a pipe body and one or more end fittings in each of which a respective end of the pipe body is terminated. FIG. 2 illustrates how pipe body 100 is formed in accordance with an embodiment of the present invention from a combination of layered materials that form a pressure-containing conduit. Although a number of particular layers are illustrated in FIG. 2, it is to be understood that the present invention is broadly applicable to coaxial pipe body structures including two or more layers manufactured from a variety of possible materials. It is to be further noted that the layer thicknesses are shown for illustrative purposes only.

As illustrated in FIG. 2, a pipe body includes an optional innermost carcass layer 101. The carcass provides an interlocked construction that can be used as the innermost layer to prevent, totally or partially, collapse of an internal pressure sheath 102 due to pipe decompression, external pressure, and tensile armour pressure and mechanical crushing loads. It will be appreciated that certain embodiments of the present invention are applicable to 'smooth bore' operations (i.e. without a carcass) as well as such 'rough bore' applications (with a carcass).

The internal pressure sheath 102 acts as a fluid retaining layer and comprises a polymer layer that ensures internal fluid integrity. It is to be understood that this layer may itself comprise a number of sub-layers. It will be appreciated that when the optional carcass layer is utilised the internal pressure sheath is often referred to by those skilled in the art as a barrier layer. In operation without such a carcass (so-called smooth bore operation) the internal pressure sheath may be referred to as a liner.

An optional pressure armour layer 103 is a structural layer with a lay angle close to 90° that increases the resistance of the flexible pipe to internal and external pressure and mechanical crushing loads. The layer also structurally supports the internal pressure sheath, and typically consists of an interlocked construction.

The flexible pipe body also includes an optional first tensile armour layer 105 and optional second tensile armour layer 106. Each tensile armour layer is a structural layer with a lay angle typically between 10° and 55°. Each layer is used to sustain tensile loads and internal pressure. The tensile armour layers are often counter-wound in pairs.

The flexible pipe body shown also includes optional layers of tape 104 which help contain underlying layers and to some extent prevent abrasion between adjacent layers.

The flexible pipe body also typically includes optional layers of insulation 107 and an outer sheath 108, which comprises a polymer layer used to protect the pipe against penetration of seawater and other external environments, corrosion, abrasion and mechanical damage.

Each flexible pipe comprises at least one portion, sometimes referred to as a segment or section of pipe body 100 together with an end fitting located at at least one end of the flexible pipe. An end fitting provides a mechanical device which forms the transition between the flexible pipe body and a connector. The different pipe layers as shown, for example, in FIG. 2 are terminated in the end fitting in such a way as to transfer the load between the flexible pipe and the connector.

Figure 3:
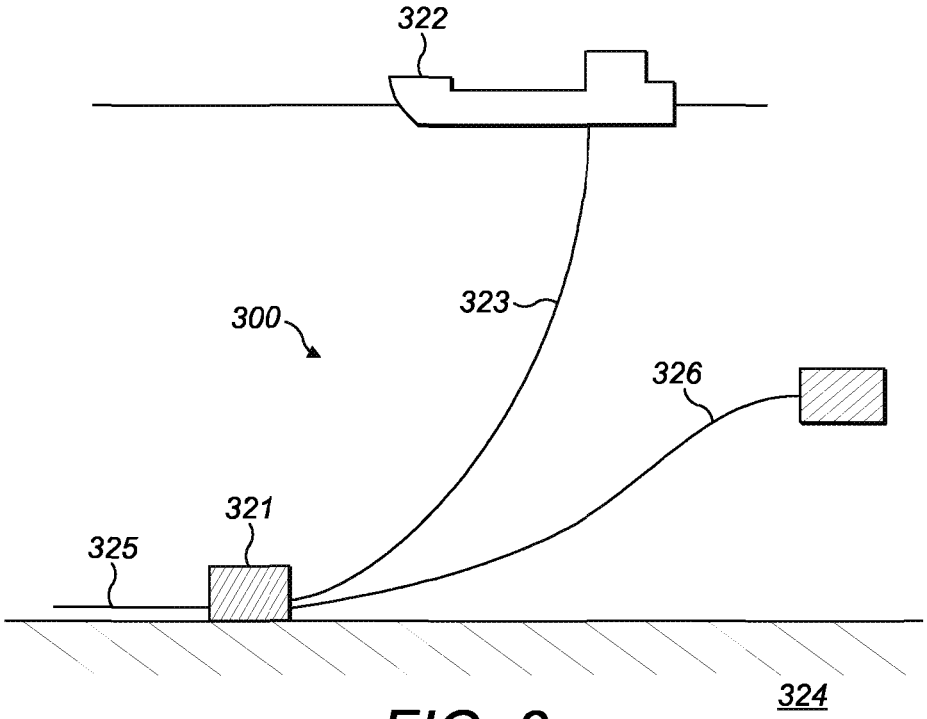
FIG. 3 illustrates another riser assembly.

FIG. 3 illustrates a riser assembly 300 suitable for transporting production fluid such as oil and/or gas and/or water from a sub-sea location 321 to a floating facility 322. For example, in FIG. 3 the sub-sea location 321 includes a sub-sea flow line. The flexible flow line 325 comprises a flexible pipe, wholly or in part, resting on the sea floor 324 or buried below the sea floor and used in a static application. The floating facility may be provided by a platform and/or buoy or, as illustrated in FIG. 3, a ship. The riser assembly 300 is provided as a flexible riser, that is to say a flexible pipe 323 connecting the ship to the sea floor installation. The flexible pipe may be in segments of flexible pipe body with connecting end fittings.

It will be appreciated that there are different types of riser, as is well-known by those skilled in the art. Embodiments of the present invention may be used with any type of riser, such as a freely suspended (free, catenary riser), a riser restrained to some extent (buoys, chains), totally restrained riser or enclosed in a tube (I or J tubes).

FIG. 3 also illustrates how portions of flexible pipe can be utilised as a flow line 325 or jumper 326.

Figure 4:
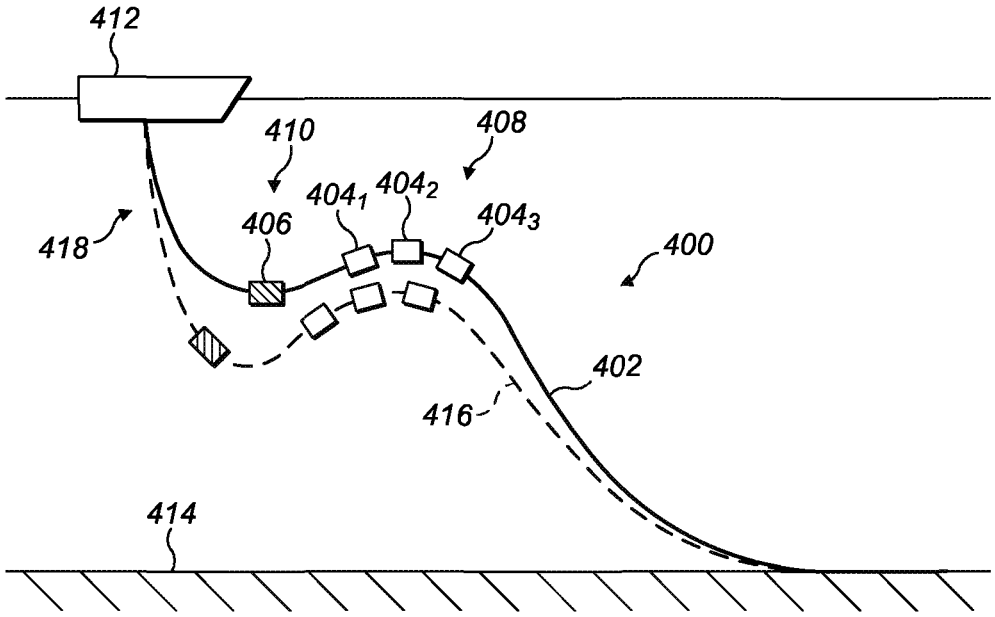
FIG. 4 illustrates a riser assembly of the present invention.

FIG. 4 shows a riser assembly 400 suitable for transporting production fluids such as oil gas and/or water according to an embodiment of the present invention. The riser assembly 400 includes a riser 402 formed of a flexible pipe, and a set of buoyancy modules (buoyancy elements) $\mathbf{404}_{1\text{-}3}$ attached to the riser 402. In this embodiment three buoyancy modules are shown, although it will be clear that any number of buoyancy modules may be used, in accordance with the specific riser configuration required for the situation. The buoyancy modules are provided to form a lazy wave configuration in this example. The wave formation includes a hog bend portion 408 and a sag bend portion 410.

In addition, the riser assembly 400 includes a weight element, which in this example is a ballast module 406 attached to the riser in the sag bend portion 410. Here the ballast module is positioned at the lowermost point of the sag bend portion of the riser (closest to the sea bed). The ballast module 406 is used to add extra weight to the sag bend portion, and at the time of installation, will somewhat offset the upwards lift (positive buoyancy) provided by the buoyancy modules 404. The ballast module 406 may be any suitable weighted component or components, and could be integrally formed with the riser rather than attached to the riser. For example, the ballast module could be a weight block, or a metal chain. The length, weight and number of ballast modules can be predetermined based upon assessment of the riser dimensions and environmental factors at the site of use. These parameters should be determined based upon the largest potential change, for example in the riser contents. There could be two or more ballast modules. The ballast module may be made from stainless steel, and may have a mass of around 400 kg in air, and length around 0.4 meters, internal diameter 0.3 meters and outside diameter 0.5 meters. Of course the specific dimensions and mass of the ballast module will depend upon factors such as the riser length, shape, dimensions, and position and amount of buoyancy modules. This can be determined by a skilled person to suit the particular application.

As illustrated in FIG. 4, the riser assembly 400 can be suspended from a floating facility, in this case a vessel 412, and extends to a sub-sea location, in this case extending along the sea bed 414.

During the working lifetime of the riser assembly, the weight of the riser may change, for example the weight of the riser assembly increasing due to the occurrence of marine growth and such like on the assembly. In this case, most of the riser will sink down towards the sea bed, as depicted by the dashed line configuration of the riser assembly 416 of FIG. 4. Of course, the end portions of the riser will remain at a set position, a first end connecting to the vessel in the region of the water surface, and a second end touching the sea bed, in this example. The change in configuration of the riser will mean that the ballast module 406 will effectively move to be located on the more vertical portion of the riser 418, between the hang-off point at the first end of the riser connecting to the vessel and the sag bend, rather than in the lowermost part of the sag bend. The section of the riser 418 suspended from the vessel, which is approximately vertical, may be effectively increased in length at the expense of the length of the remaining sections of riser. Because of this effective shift in position of the ballast module, the weight of the ballast module will be taken by the vessel 412, and not by the buoyancy modules 404. This effectively frees up the capacity of the buoyancy modules by removing the weight from the ballast module that was previously offsetting the buoyancy modules, and thus gives the buoyancy modules relatively increased buoyancy, enabling them to offset the weight of the marine growth on the riser instead.

As such, the riser assembly is able to offset additional weight caused by marine growth. The general shape of the riser assembly is only changed by a relatively small degree compared to its initial deployment position. In addition, the height of the sag bend and hog bend above the sea bed are unchanged or only changed by a relatively small degree compared to their initial deployment position. It is to be noted that the before and after positions shown in FIG. 4 are for understanding only, and may not represent the actual riser configuration after marine growth has occurred as described above. For example, if the riser moves to a position where the ballast module is on the vertical section and the weight of the ballast is taken by the vessel, then the buoyancy modules could rise upwards back to their original height above the sea bed.

Alternatively, or additionally, the buoyancy modules may experience a gradual or sudden change in content density due to movement of the riser assembly or general day to day wear. Or indeed the flexible pipe itself may experience a buoyancy change during service life from variation in content density (for example between states of being empty to being flooded, or carrying different fluids). This may cause the amount of buoyancy support (and therefore the relative height above the sea bed) of the riser to change. Again, with the ballast module 406 provided initially in the sag bend, a reduction of buoyancy in the buoyancy elements 404 would lead to the vertical section of the riser effectively lengthening, and the relative position of the ballast module 406 shifting towards the more vertical section of the riser. The buoyancy modules would then be freed from the weight of the ballast and able to provide more upward buoyancy to counteract the effect of net buoyancy loss or riser content variation, as described above.

It is to be noted that movement of the vessel 412 will not generally depose the ballast module 406 from its position at the sag bend portion 410, since any movement of the vessel (whether it be to a near or far position from the touch-down point of the riser) will be accompanied by movement of the riser assembly as a whole. The buoyancy modules and ballast module will work together to automatically adjust the height of the hog bend in the same manner as discussed above.

The riser assembly provides a reasonable degree of excursion from the touchdown point (where the riser touches the sea bed) in a neat and relatively easy to install configuration.

Figure 8:
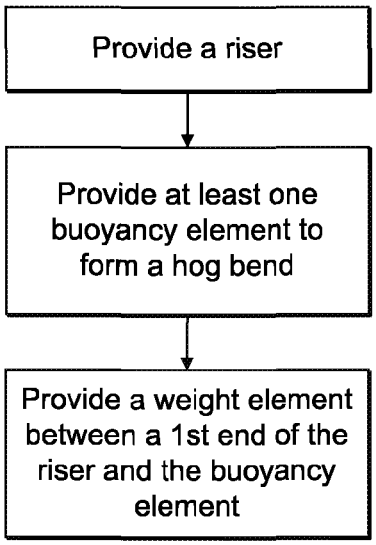
FIG. 8 is a flowchart illustrating a method of the present invention.

In manufacture of the riser assembly, the method may include providing a riser comprising at least one segment of flexible pipe, the riser having a first end for connection to a floating facility and a further end; providing at least one buoyancy element for enabling a portion of the riser to form a hog bend configuration and an adjacent portion of the riser to form a sag bend configuration; and providing a weight element between the first end of the riser and the at least one buoyancy element, such that in an initial deployment position, the weight element is provided at least partially in the sag bend portion of the riser. A flow diagram illustrating the method is shown in FIG. 8. It is to be noted that the order of steps are not necessarily limited to the order shown in the flow diagram.

The necessary elements of the riser assembly may be provided either in the factory at the point of manufacturing the flexible pipe, or the buoyancy element and/or weight element may be added to the pipe later, aptly prior to or at the time of deployment of the riser.

Figure 5:
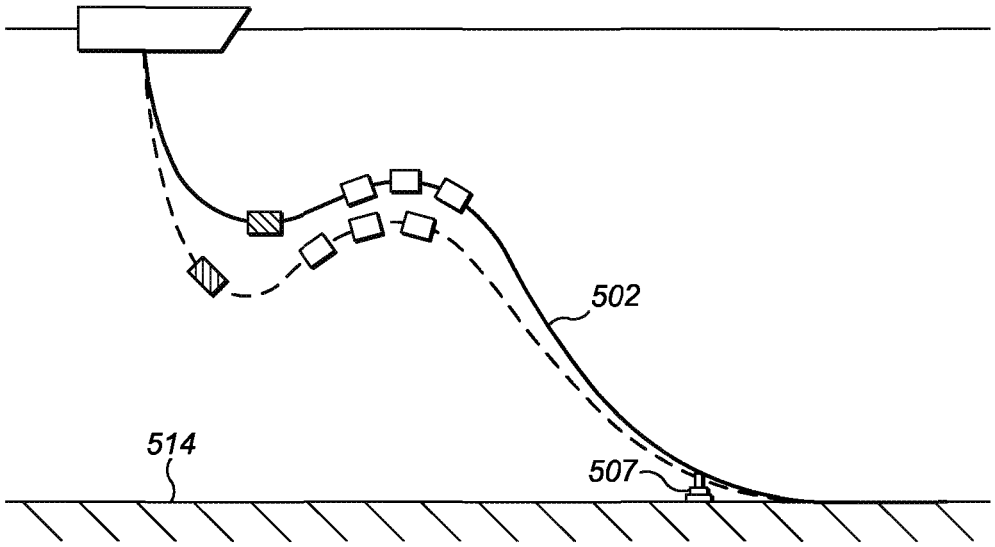
FIG. 5 illustrates another riser assembly of the present invention.

A further embodiment of the present invention is shown in FIG. 5. The embodiment is similar to that shown in FIG. 4. However, a lower portion of the riser is affixed or tethered to the sea bed by a tethering element 507 (a clamp around the flexible pipe is attached to an anchor ring, for example). The point at which the tether is connected to the riser can be chosen to suit the particular riser configuration, but aptly will be a point in the region of where the riser comes into contact with the sea bed 514.

A tethering element is useful in helping to prevent the riser assembly from knocking against the sea floor with strong currents, for example, which may damage the riser. A tethering element may be used to apply a certain degree of tension to the lower portion of the riser. This may help to maintain the hog bend portion of the riser a predetermined distance from the water surface (and the sea bed).

Figure 9:
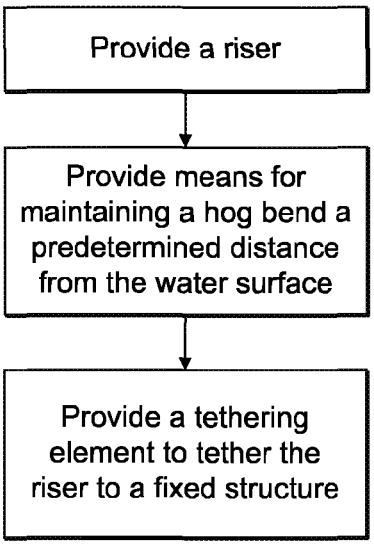
FIG. 9 is a flowchart illustrating another method of the present invention.

A flow diagram illustrating a method of producing a riser assembly is shown in FIG. 9.

Figure 6:
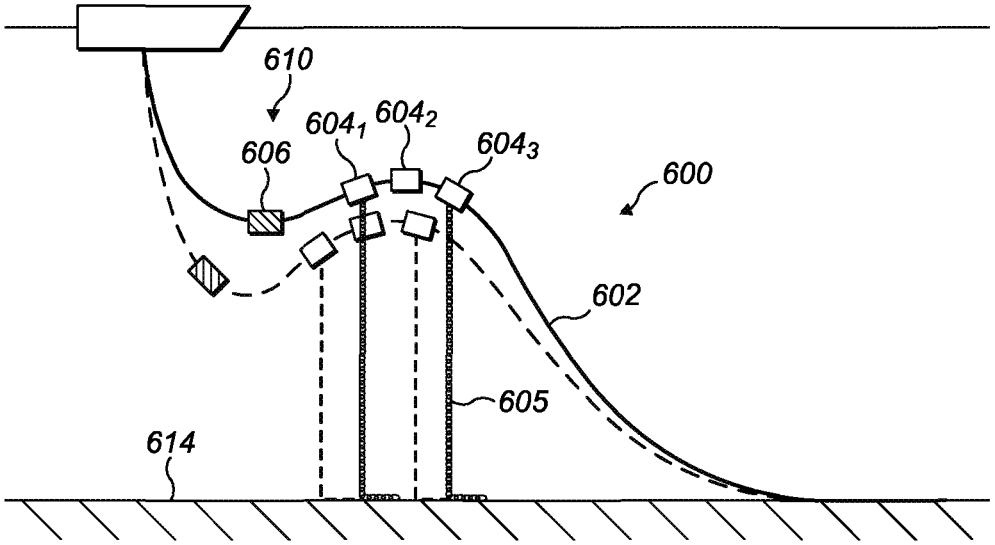
FIG. 6 illustrates another riser assembly of the present invention.

A yet further embodiment of the present invention is shown in FIG. 6. In this embodiment, the riser assembly 600 includes a riser 602 formed of a flexible pipe, and a set of buoyancy modules $\mathbf{604}_{1\text{-}3}$ attached to the riser 602. The buoyancy modules are provided to form a lazy wave configuration. The riser assembly 600 also includes a weight element, which in this example is a ballast module 606, attached to the riser 602 in the sag bend portion 610.

The riser assembly 600 further includes weight chains 605 consisting of a length of interlocked links secured to a number of the buoyancy modules 604. Of course in other embodiments there could be more or less weight chains, and the chains could be connected directly to the flexible pipe or another part of the riser, rather than the buoyancy modules. A weight chain 605 may be secured to each buoyancy module secured to the riser or may be selectively secured to only one or more of the buoyancy modules.

The weight chains act as a self-adjusting mechanism to the riser assembly 600. The weight associated with the mass of chain in the length of chain counteracts the buoyancy provided by the buoyancy module to which the weight chain is secured and the inherent buoyancy of the flexible pipe. As such the elevation of the hog bend portion of the riser above sea level should be stabilized.

A section of the weight chain 506 hangs freely downwardly from the buoyancy module towards the sea bed 614. A further portion of the weight chain rests upon the surface of the sea bed 614. In this way a part of the weight chain is laid on the sea bed. It will be appreciated that as conditions experienced by the flexible pipe change, such as when the density of content within the flexible pipe changes the result will be a tendency for the buoyancy modules and flexible pipe to move upwardly away from the sea bed or downwardly towards the sea bed. As such movement occurs more or less chain will rest upon the sea bed. For example, when the riser content density reduces the buoyancy will be balanced by the additional chain weight as it is lifted from the sea bed. When the riser content density increases the buoyancy will be balanced by reduced chain weight as the additional chain is laid on the sea bed. In this way the support provided to the flexible pipe is automatically and continually adjusted so as to maintain the flexible pipe in a desired configuration or at least in a configuration within predetermined threshold limits.

With the ballast module 606 also attached to the riser 602, this helps the self-adjusting mechanism further, by helping to automatically offset any changes in buoyancy/height changes in the buoyancy modules (in the manner discussed above regarding FIG. 4). The ballast module may be considered a supplementary measure to enhance the advantages provided by the weight chains.

In an alternative embodiment, the riser assembly 600 could additionally include a tethering element for tethering a lower portion of the riser to the sea bed, to help prevent the riser assembly from knocking against the sea floor with strong currents, for example, which may damage the riser.

Figure 7:
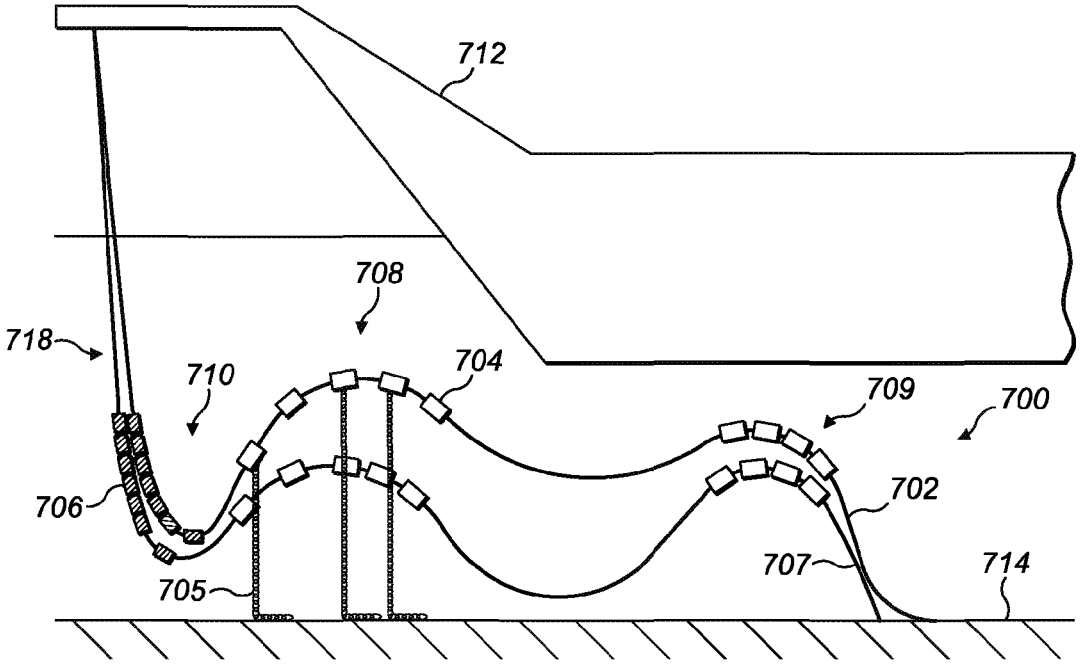
FIG. 7 illustrates another riser assembly of the present invention.

FIG. 7 illustrates a further embodiment of the invention, in which the riser assembly 700 forms a double wave configuration. Here buoyancy modules 704 are positioned along the riser 702 forming a first hog bend 708 and a second hog bend 709. Weight chains 705 are suspended from the riser portion forming the first hog bend 708, in a manner similar to that shown in FIG. 6. A lower portion of the riser 702 is affixed or tethered to the sea bed 714 by a tethering element 707. In addition, the riser assembly 700 includes a number of ballast modules 706. The ballast modules 706 are attached to the riser 702 at various points in the sag bend portion 710, from the lower portion of the hang-off section 718 to an approximately central portion of the sag bend 710.

The weight chains 705 help to stabilize the elevation of the first hog bend 708, as discussed above. The weight chains also stabilize the elevation of the hog bend when the configuration of the riser assembly is altered due to changes in the surface vessel position from a near to far or far to near position, for example. That is, if the vessel 712 moves from a position close to the sea bed touching portion of the riser to a position far from the sea bed touching portion of the riser, then the riser will extend out more horizontally, which may affect the positions of the buoyancy modules. However, the action of the weight chains will automatically adjust and compensate for any change in height of the buoyancy elements.

The ballast modules 706 act as a means of pre-storing additional weight into the riser system, also helping to counteract changes in riser weight.

The buoyancy modules at the second hog bend 709 help to offset the riser weight and minimise any tension in the riser.

The tether element 707 helps to prevent the riser assembly from knocking against the sea floor with strong currents, for example, which may damage the riser, and helps to maintain the second hog bend portion 709 of the riser a predetermined distance from the water surface (and the sea bed).

The configuration of FIG. 7 is particularly useful in ensuring that minimum clearance distances between a hog bend and the water surface, and between a sag bend and the sea bed, can be achieved, even in particularly shallow water applications, such as less than 100 meters, or even less than 40 meters. The combination of the weight chains and tether element also restricts the riser movements brought on by the weather prevailing from a cross direction. That is, when waves and current move in a direction against the general plane of the riser (e.g. move parallel to the sea bed), the riser will be forced to deflect from its position. However, the tether element being anchored to the sea bed and the weight chains causing drag resistance along the sea bed, help to reduce the riser deflection. This also helps to prevent a riser colliding with an adjacent riser.

The riser assembly can accommodate severe environmental loading, large surface vessel excursions, and large variations in riser weight due to changes in content density and marine growth, etc.

Various modifications to the detailed designs as described above are possible. For example, the number of ballast modules and/or number of buoyancy modules could be any number, depending on the specific requirements of different uses and situations. The ballast module(s) and/or buoyancy module(s) could be attached to or integrated with the riser.

It can be seen that the addition of a weight element to a riser configuration can be applied to various riser configurations, either alone or in combination with other measures (as a supplementary measure) to help control the riser configuration. The invention is therefore suitable for many different applications.

The present invention may be used for a single waved configuration of a riser, or a double waved configuration, or a triple waved configuration.

Although the riser has been described above as having an approximately vertical portion suspended from the vessel or floating facility, this portion need not be generally vertical. The suspended portion of the riser may be at any angle, with the angle moving closer to the vertical as the weight of the riser increases.

Although the invention has been described above with a riser extending between a floating facility (such as a vessel) and the sea bed, the riser could alternatively extend between fixed or floating platforms at different heights above the sea bed.

As an alternative to a weight chain extending from the buoyancy module to the sea bed, a top section of a weight chain may be replaced or provided by an alternative flexible filament such as a synthetic rope, wire, cable or the like. A weight chain or other weighted, flexible element may be secured at a lower end region of the filament so that again a portion of the weight chain rests upon the sea bed.

It will be clear to a person skilled in the art that features described in relation to any of the embodiments described above can be applicable interchangeably between the different embodiments. The embodiments described above are examples to illustrate various features of the invention.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A riser assembly for transporting fluids from a sub-sea location, comprising:

a riser comprising at least one segment of flexible pipe, the riser having a first end for connection to a floating facility and a further end;

at least one buoyancy element connected to a portion of the riser for enabling the portion of the riser to form a hog bend configuration and an adjacent portion of the riser to form a sag bend configuration;

a weight chain suspended from the at least one buoyancy element, the weight chain extending from the at least one buoyancy element at the hog bend portion of the riser towards a sea bed, said weight chain being sufficiently long such that at least a portion thereof rests on the sea bed; and a ballast module connected to a further portion of the riser between the first end of the riser and the at least one buoyancy element, such that the ballast module is spaced apart from the at least one buoyancy element and such that in an initial deployment position, the ballast module is provided at least partially in the sag bend portion of the riser;

wherein in the initial deployment position, the at least one buoyancy element has a positive buoyancy that provides an upwards force, and the ballast module has a negative buoyancy that provides a downwards force, and the positive buoyancy at least partially offsets the negative buoyancy; and wherein the ballast module is positioned such that if the positive buoyancy is reduced, the riser assembly moves to a position where the ballast module is increasingly supported by the floating facility.

2. A riser assembly according to claim 1, wherein the at least one buoyancy element is secured to the riser to form a waved configuration.

3. A riser assembly according to claim 1, further comprising at least one further buoyancy element for enabling the riser to form a double-waved or triple-waved or multi-waved configuration.

4. A riser assembly according to claim 3, further comprising a tethering element for tethering the riser in the region of the further end to a fixed structure.

5. A riser assembly according to claim 1, further comprising:

a tethering element for tethering the riser in a region of a touch-down point to a fixed structure, wherein the touch-down point is a region of the riser that contacts the sea bed or a fixed structure adjacent a suspended region of the riser.

6. A riser assembly according to claim 1, wherein the assembly is suitable for shallow water use.

7. A method according to claim 1, further comprising:

providing a tethering element for tethering the riser in a region of a touch-down point to a fixed structure, wherein the touch-down point is a region of the riser that contacts the sea bed or a fixed structure adjacent a suspended region of the riser.

8. A method according to claim 1, wherein the assembly is used in shallow water.

9. Use of the riser assembly according to claim 1, for the transportation of production fluids.

10. A method of providing a riser assembly for transporting fluids from a sub-sea location, comprising:

providing a riser comprising at least one segment of flexible pipe, the riser having a first end for connection to a floating facility and a further end;

connecting at least one buoyancy element to a portion of the riser for enabling the portion of the riser to form a hog bend configuration and an adjacent portion of the riser to form a sag bend configuration;

providing a weight chain suspended from the at least one buoyancy element, the weight chain extending from the at least one buoyancy element at the hog bend portion of the riser towards a sea bed, said weight chain being sufficiently long such that at least a portion of the weight chain rests on the sea bed; and connecting a ballast module to a further portion of the riser between the first end of the riser and the at least one buoyancy element, such that the ballast module is spaced apart from the at least one buoyancy element and such that in an initial deployment position, the ballast module is provided at least partially in the sag bend portion of the riser, wherein in the initial deployment position, the at least one buoyancy element has a positive buoyancy that provides an upwards force, and the ballast module has a negative buoyancy that provides a downwards force, and the positive buoyancy at least partially offsets the negative buoyancy; and wherein the ballast module is positioned such that if the positive buoyancy is reduced, the riser moves to a position where the ballast module is increasingly supported by the floating facility.

11. A method according to claim 10, wherein the at least one buoyancy element is secured to the riser to form a waved configuration.

12. A method according to claim 10, further comprising providing at least one further buoyancy element for enabling the riser to form a double-waved or triple-waved or multi-waved configuration.

13. A method according to claim 12, further comprising providing a tethering element for tethering the riser in the region of the further end to a fixed structure.

14. A riser assembly for transporting fluids from a sub-sea location, comprising:

a riser comprising at least one segment of flexible pipe, the riser having a first end for connection to a floating facility and a further end;

a plurality of buoyancy elements connected to a portion of the riser, for enabling the portion of the riser to form a hog bend configuration and an adjacent portion of the riser to form a sag bend configuration;

a weight chain extending from a proximal end suspended from one of said plurality of buoyancy elements to a distal end, the weight chain being sufficiently long such that at least a portion of the weight chain rests on the sea bed; and a ballast module connected to a further portion of the riser between the first end of the riser and the at least one buoyancy element, such that the ballast module is spaced apart from the plurality of buoyancy elements and such that in an initial deployment position, the ballast module is provided at least partially in the sag bend portion of the riser;

wherein in the initial deployment position, the at least one buoyancy element has a positive buoyancy that provides an upwards force, and the ballast module has a negative buoyancy that provides a downwards force, and the positive buoyancy at least partially offsets the negative buoyancy; and wherein the ballast module is positioned such that if the positive buoyancy is reduced, the riser moves to a position where the ballast module is increasingly supported by the floating facility.

15. The riser assembly of claim 14, wherein said weight chain is tethered only to one of said plurality of buoyancy elements.

* * * * *